United States Patent [19]

Ferretti

[11] 4,420,422

[45] Dec. 13, 1983

[54] METHOD FOR MAKING HIGH SURFACE AREA BISMUTH-CONTAINING PYROCHLORES

[75] Inventor: August Ferretti, Wilmington, Del.

[73] Assignee: E. I. Du Pont de Nemours & Co., Wilmington, Del.

[21] Appl. No.: 438,717

[22] Filed: Nov. 1, 1982

[51] Int. Cl.[3] ..... H01B 1/06

[52] U.S. Cl. ..... 252/518; 252/521; 423/593

[58] Field of Search ..... 252/518, 521; 423/593; 106/1.22, 1.25

[56] References Cited

U.S. PATENT DOCUMENTS

| | | | |
|---|---|---|---|
| 3,583,931 | 6/1971 | Bouchard | 252/520 |
| 4,124,539 | 11/1978 | Horowitz et al. | 252/518 |
| 4,129,525 | 12/1978 | Horowitz et al. | 252/518 |
| 4,163,706 | 8/1979 | Horowitz et al. | 252/518 |
| 4,192,780 | 3/1980 | Horowitz et al. | 252/518 |
| 4,203,871 | 5/1980 | Horowitz et al. | 252/518 |
| 4,225,469 | 9/1980 | Horowitz et al. | 252/518 |
| 4,302,362 | 11/1981 | Hoffman et al. | 252/518 |

*Primary Examiner*—Josephine Barr

[57] ABSTRACT

Method for making a pyrochlore of the formula $Bi_{2-x}M_xB_2O_{7-z}$ by firing finely divided particles of bismuth oxycarbonate. The pyrochlores made by the invention have a high surface area and are especially useful as the conductive phase for thick film resistors.

6 Claims, 1 Drawing Figure

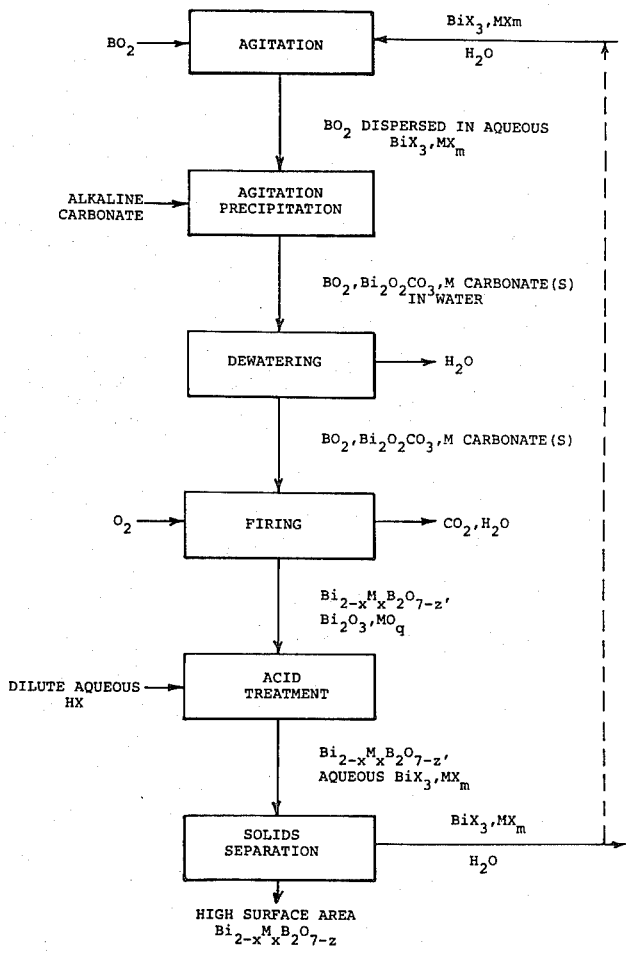

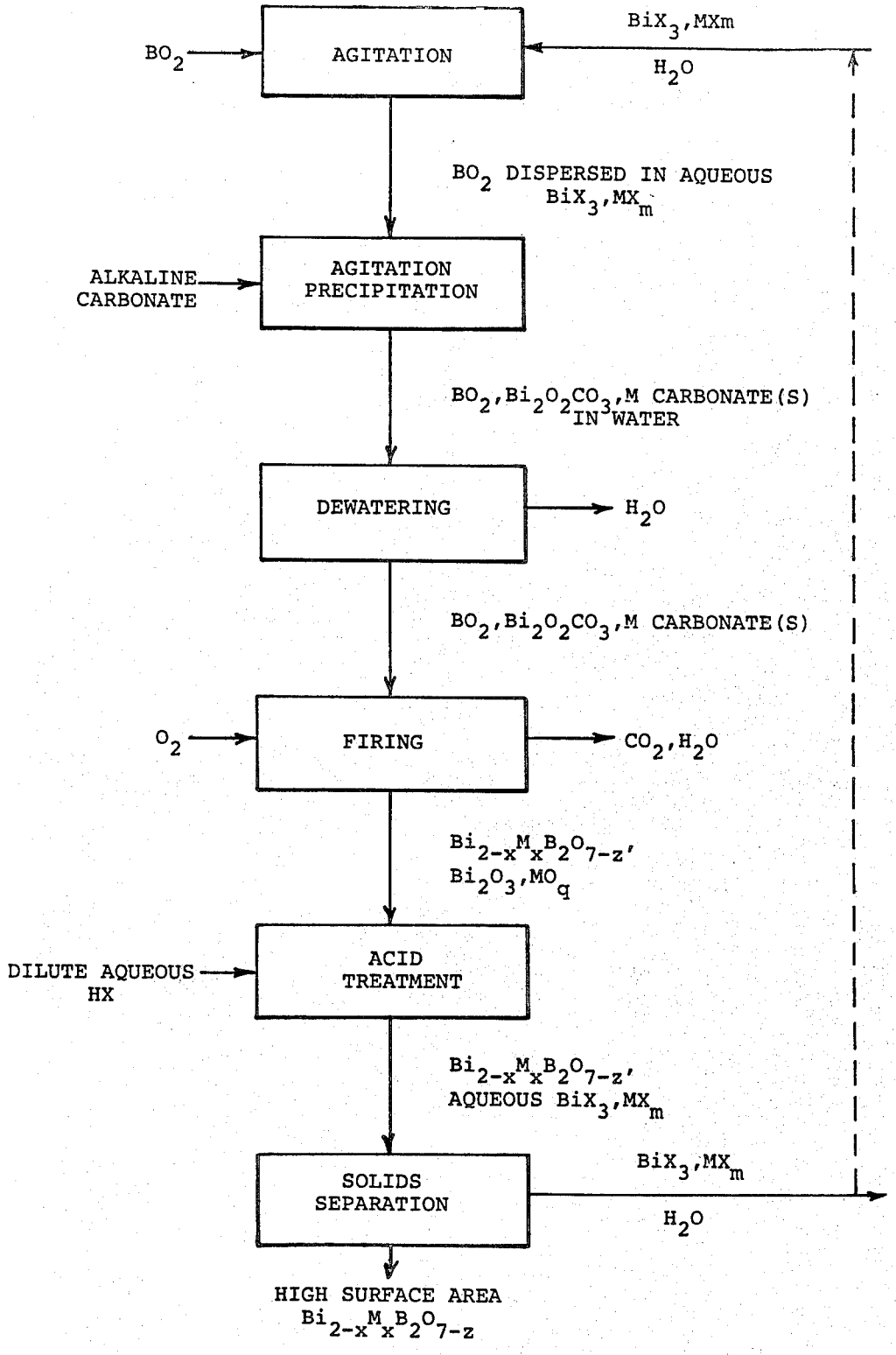
$BO_2$
AGITATION
$BiX_3$,MXm
$H_2O$
$BO_2$ DISPERSED IN AQUEOUS $BiX_3$,$MX_m$
ALKALINE CARBONATE
AGITATION PRECIPITATION
$BO_2$,$Bi_2O_2CO_3$,M CARBONATE(S) IN WATER
DEWATERING
$H_2O$
$BO_2$,$Bi_2O_2CO_3$,M CARBONATE(S)
$O_2$
FIRING
$CO_2$,$H_2O$
$Bi_{2-x}M_xB_2O_{7-z}$,
$Bi_2O_3$,$MO_q$
DILUTE AQUEOUS HX
ACID TREATMENT
$Bi_{2-x}M_xB_2O_{7-z}$,
AQUEOUS $BiX_3$,$MX_m$
SOLIDS SEPARATION
$BiX_3$,$MX_m$
$H_2O$
HIGH SURFACE AREA
$Bi_{2-x}M_xB_2O_{7-z}$

METHOD FOR MAKING HIGH SURFACE AREA BISMUTH-CONTAINING PYROCHLORES

FIELD OF THE INVENTION

The invention is directed to a method for making bismuth-containing pyrochlores for use in thick film resistors.

BACKGROUND OF THE INVENTION

Thick film materials are mixtures of metal, glass and/or ceramic powders dispersed in an organic medium. These materials, which are applied to nonconductive substrates to form conductive, resistive or insulating films, are used in a wide variety of electronic and light electrical components.

Most thick film compositions contain three major components. The conductive phase determines the electrical properties and influences the mechanical properties of the final film. The binder, usually a glass and/or crystalline oxide, holds the thick film together and bonds it to the substrate, while the organic medium (vehicle) is the dispersing medium which influences the application characteristics of the composition and particularly its rheology.

One of the most important and widely used class of materials for the conductive phase of thick film resistors are noble metal polyoxides which have the basic pyrochlore structure of $A_2B_2O_7$, in which A is typically bismuth or lead, and B is ruthenium or iridium. In addition, the crystal lattice of this material can also be substituted with other metallic elements. For example, Bouchard in U.S. Pat. No. 3,583,931 discloses the use in thick film resistors of bismuth-containing pyrochlores having the structure $(Bi_{2-x}M_x)(M'_yM_{2-y}'')O_{7-z}$, in which M is yttrium, thalium, indium, cadmium, lead and certain rare earth metals, M' is platinum, titanium, chromium, rhodium or antimony, and M'' is iridium or ruthenium.

A number of U.S. patents to Horowitz et al. disclose pyrochlores of the general formula $A_2[B_{2-x}A_x]O_{7-y}$, in which A is bismuth or lead, and B is ruthenium or iridium.

In general, the above-described pyrochlores have been prepared by either of two methods. The first is a solid state reaction, and the second is a liquid phase reaction in an aqueous alkaline medium. Bouchard, U.S. Pat. No. 3,583,931, discloses a solid state reaction process for making the bismuth-containing pyrochlores with the formula given above in which a mixture of the metal oxides or oxide precursors is fired at 600°-1200° C., preferably 750°-1000° C., for from one to 30 hours. Horowitz et al., U.S. Pat. No. 4,124,539, disclose a solid state reaction process for making lead-rich pyrochlores of the formula $Pb_2(B_{2-x}Pb_x)O_{7-y}$, where $0<x<1.2$, in which a mixture of a powdered lead source such as lead nitrate and a powdered ruthenium and/or iridium source, chosen so that the molar ratio of Pb to Ru and/or Ir is at least 1:1 and preferably 1.3:1.0 to 5.0:1.0, is reacted at temperatures below about 600° C. in an oxygen-containing atmosphere.

There are several processes using the liquid alkaline reaction medium (see Horowitz et al., U.S. Pat. Nos. 4,129,525; 4,176,094; 4,192,780; 4,225,469), each of which involves reacting bismuth and/or lead cations with ruthenium and/or iridium cations in a liquid alkaline medium at temperatures below 200° 1 C. The product produced by these methods has the advantage that it is of desirably small particle size (large surface area), but the methods generally require uneconomically long reaction times.

Thus, while the solid state method with firing at higher temperatures is economical, the surface area of the product obtained is lower than desired. Furthermore, the bismuth pyrochlore generally contains a second phase when prepared by a process similar to the solid state reaction of U.S. Pat. No. 4,124,539. On the other hand, the second method produces pyrochlores of quite high surface area, but the process is considerably less economical. Consequently, there is a real need for a bismuth pyrochlore manufacturing process which is both economical and which results in a high surface area product.

SUMMARY OF THE INVENTION

The problems of the prior art methods for making pyrochlores of the general type $Bi_{2-x}M_xB_2O_{7-z}$ for use in resistors are substantially overcome by the invention, which is a process for making such pyrochlores wherein M is selected from the group consisting of cadmium, copper, lead, indium, gadolinium, silver and mixtures thereof, B is selected from the group consisting of ruthenium, iridium and mixtures thereof, x is from 0 to 0.5, and z is 0 to 1, said pyrochlores having a surface area exceeding 15 $m^2/g$, comprising the sequential steps of:

(a) firing an intimate admixture of finely divided particles of $BO_2$, $Bi_2O_2CO_3$ and carbonate(s) of M when x is greater than zero at a temperature between the thermal decomposition temperature of $Bi_2O_2CO_3$ and 650° C. in an oxidizing atmosphere to form a reaction product comprising $Bi_2O_3$, $Bi_{2-x}M_xB_2O_{7-z}$ and oxide(s) of M, the mole ratio of Bi and B being at least 1.4 to 1;

(b) forming a dispersion of the fired reaction product of step (a) in dilute aqueous mineral acid in an amount and for a time sufficient to dissolve substantially all the $Bi_2O_3$ and oxides of M, if present, in the reaction product;

(c) and separating the acid-treated reaction product of step (d) from the dispersing medium.

If M is to be present in the product, it may be added as M nitrate or chloride in step (a).

In a further aspect of the invention, the intimate admixture of finely divided particles of $BO_2$,$Bi_2O_2CO_3$ and carbonate(s) of M is derived by:

(a) forming a dispersion of finely divided particles of $BO_2$ in an aqueous acidic solution of $BiX_3$, and when x is greater than 0, $MX_m$, wherein X is selected from the group consisting of nitrate, chloride and mixtures thereof and m is the valence of M;

(b) adding to the dispersion of step (a) with agitation to effect rapid dispersion therein an aqueous solution of an alkaline carbonate selected from the group consisting of sodium carbonate, potassium carbonate, and, except when M is copper, ammonium carbonate and mixtures thereof to effect precipitation of finely divided particles of $Bi_2O_2CO_3$ and carbonate(s) of M throughout the dispersion, the amount of alkaline carbonate being sufficient to precipitate substantially all of the Bi and M from solution; and (c) drying the dispersion of step (b).

BRIEF DESCRIPTION OF THE DRAWING

The drawing consists of a single FIGURE which is a block flow diagram showing the sequence of steps for the preferred process for carrying out the invention in which the admixture of $Bi_2O_2CO_3$ and $BO_2$ is derived from precipitation with alkaline carbonate of $BiX_3$ dissolved in an aqueous dispersion of finely divided particles of $BO_2$.

DETAILED DESCRIPTION OF THE INVENTION

The process for preparing bismuth-containing pyrochlores is discussed in detail below. By bismuth-containing pyrochlores, we mean those pyrochlores having the formula $(Bi_{2-x}M_x)B_2O_{7-z}$ as defined above.

The admixture of $BO_2$ and $Bi_2O_2CO_3$ (and optionally M carbonate when x is greater than 0) can be made in a variety of ways such as by either dry or wet blending the powders or by precipitation of the $Bi_2O_2CO_3$ in an aqueous dispersion of the $BO_2$. The precise manner in which the reaction admixture is formed is, therefore, not so important as is the intimacy of the admixture of these materials. That is, the admixture must be formed of finely divided particles of both the oxide and carbonate materials, and the particles must be quite thoroughly mixed so as to form a compositionally uniform mixture.

It is, however, essential that the amount of Bi be in molar excess of the $BO_2$ to assure that high surface area pyrochlores are produced by the process. A Bi/B mole ratio of at least 1.4:1 is considered essential, and a ratio of 4:1 is preferred. Especially when the process is conducted beginning with a dry admixture of $Bi_2O_2CO_3$ and $BO_2$, a Bi/B mole ratio of at least 5:1 is preferred. Even higher ratios such as 10:1 can be used advantageously. However, ratios of Bi/B beyond about 5:1 are probably not justified because of their cost and because of the cost of extracting the excess oxide from the pyrochlore reaction product.

In addition to its function of helping to avoid impurity phase formation, the excess Bi is also advantageous in the following ways:

(a) to promote better dispersion of the ruthenium and/or iridium oxide that was introduced into the initial mixture as a solid, (b) to allow the reaction to proceed to completion without the need of grinding and refiring, and (c) to reduce the tendency of the resulting pyrochlore phase to coalesce and fuse at the grain boundaries.

It is desirable to use $BO_2$ of the highest surface area which is available at reasonable cost because this results in a faster reaction rate. For this reason a particle size corresponding to a surface area of at least 20 $m^2/g$ is preferred. A particle size corresponding to a surface area of at least 30 $m^2/g$ is preferred even further. Typically, particles of average size corresponding to 30–60 $m^2/g$ have been used. Furthermore, when the $BO_2$ is admixed with $Bi_2O_2CO_3$ powders, it is similarly desirable to use high surface area $Bi_2O_2CO_3$. Therefore, it is preferred that the particle size of the $Bi_2O_2CO_3$ also correspond to a surface area of at least 20 $m^2/g$.

It will be recognized by those skilled in the art that the relative amounts of Bi and M contained in the final pyrochlore product may differ somewhat from the amounts in the reaction dispersion. Any unreacted Bi or M will be in the form of oxides which are readily extracted by acid as described hereinbelow.

A preferred method for forming the intimate reaction admixture of $Bi_2O_2CO_3$, M carbonate and $BO_2$ is by precipitation with alkaline carbonate of an aqueous dispersion of $BO_2$ in a solution of a soluble bismuth salt and, when $x>0$, a soluble M salt as well.

In forming the dispersion of $BO_2$, either aqueous HCl or $HNO_3$ or mixtures thereof can be used as the dispersion medium. Moreover, acid strength is not at all critical so long as the dispersion medium is sufficiently on the acid side to keep the bismuth chloride or bismuth nitrate in solution. Nevertheless, in order to minimize the amount of alkaline carbonate which must be added to precipitate $Bi_2O_2CO_3$, it is preferred to keep the acidity to a minimal level.

The bismuth nitrate or chloride can be added directly to the aqueous acid, or a suitable bismuth compound, e.g., $Bi_2O_3$ or $Bi_2O_2CO_3$, can be dissolved in $HNO_3$ or HCl solution to form the bismuth nitrate or chloride.

Likewise, the soluble salt of the element M can be handled in the same manner. However, some adjustment of the relative amounts of the soluble M salts may be needed to accommodate differences in solubility which can be anticipated in the subsequent precipitation step.

Suitable alkaline carbonates for the precipitation step include sodium, potassium and ammonium carbonates. However, ammonium carbonates cannot be used effectively as the precipitation agent when M is copper for the reason that they form a soluble complex with the copper compound which does not precipitate. Thus, when M is copper, only sodium and potassium carbonate and sodium bicarbonate can be used. Sodium carbonate is preferred.

The concentration of the alkali carbonate solution does not appear to be important. Either dilute or concentrated solutions can be used so long as the total amount of carbonate is sufficient to precipitate all of the Bi dissolved in the aqueous dispersion. In general, concentrated solutions will be preferred since smaller liquid volumes will have to be handled to precipitate a given quantity of $Bi_2O_2CO_3$.

A quite important aspect of the precipitation step, particularly when the Bi/B ratio is low, is that the dispersion must be kept in a quite highly dispersed state so that the added carbonate precipitate is rapidly dispersed throughout the system and no significant localized concentration gradients are set up in the system. This is essential to avoid the formation of undesirable by-products such as other pyrochlore-related materials and to avoid leaving unreacted $BO_2$ in the dispersion. This requires a very high degree of agitation such as is obtained with a high shear mixing device. Because of the necessity for minimizing such concentration gradients, the rate of adding the alkali carbonate must be lowered when the degree of dispersion is less, but can be raised when the degree of dispersion is higher. That is, the precipitant can be added faster without adverse effect as the degree of agitation is increased. In this regard, it has been found that a suitably high degree of mixing is obtained by the use of high speed blenders and ultrasonic and jet stream type mixing devices.

The temperature of the precipitation step is not at all critical and can be conducted at virtually any temperature at which the dispersion medium remains liquid. Thus, the temperature for the precipitation will usually be 20°–100° C. and frequently 50°–70° C. Likewise, the time for precipitation is not itself critical.

Upon completion of the precipitation, the admixture of $BO_2$ and $Bi_2O_2CO_3$ is substantially dewatered prior to firing by centrifuging or filtering out the solids. The solids are then dried. It is preferred, but not essential, to wash the filtered precipitate with water to remove water-soluble by-products prior to firing.

The firing step must be conducted above the decomposition temperature of the precipitated $Bi_2O_2CO_3$ and the carbonates of M, if they are present, but at a temperature no higher than about 650° C. Bismuth oxycarbonate decomposes at temperatures somewhat above 375° C. Though most of the carbonates of M such as $PbCO_3$, $CuCO_3$ and $Ag_2CO_3$ have decomposition temperatures below 375° C., the decomposition temperatures of some M carbonates may be higher. For example, $CdCO_3$ decomposes at about 500° C., in which case the firing temperature must exceed 500° C. In any event, the minimum appropriate firing temperature can easily be determined by any one skilled in the art by examination of the fired material by X-ray diffraction to observe the presence of more than two solid state decomposition products.

The rate of reaction during firing is directly related to the firing temperature. However, as the firing temperature is increased, espcially above about 650° C., the surface area of the resultant particles is reduced.

The firing time must be sufficient to effect complete decomposition of the oxycarbonate and the M carbonate, if it is present, and reaction with $BO_2$. When firing at about 50° C. above the decomposition temperature, as little as one hour at that temperature (excluding heat-up and cooling) has been shown to be sufficient. However, longer reaction times up to several hours will ordinarily be used. Firing times beyond those required to obtain complete reaction ordinarily have no adverse effect on the fired product.

It is essential that the firing step be conducted under oxidizing conditions to effect complete carbon removal from the reaction system. For this purpose, air will ordinarily be sufficient. Atmospheres containing less oxygen can be used but will require longer reaction time. Atmospheres having higher oxygen content might also be used, but are not significantly advantageous.

Upon cooling, the fired reaction product, which is in finely divided form, is slurried in dilute aqueous HCl or $HNO_3$. From the standpoint of dissolving out the oxide $Bi_2O_3$ or the oxide of metal M, the concentration of the acid is not critical. However, if the acid is too concentrated, it may chemically react with the pyrochlore. On the other hand, if the aqueous acid is too dilute, it will require an excessive time to remove all the $Bi_2O_3$ and other oxides. In any event, enough acid of whatever strength is used must be applied to dissolve out all of the $Bi_2O_3$.

The degree of agitation needed for this step is not high and need be only sufficient to assure contact of the fired particles with the acid. Size reduction of the reaction product of the firing step step, e.g., by milling or grinding, is not required since the particles are already of sufficiently small size to facilitate ready dispersion with only mild mixing.

The temperature of the acid treating step is not critical and it is generally preferred to use a temperature between 20°–40° C. The time for washing out the $Bi_2O_3$ and other oxides depends on the batch size and the amount of $Bi_2O_3$ to be removed. Higher acid concentrations permit shorter washing times. A washing acid concentration of 5–50% by volume is preferred. The adequacy of the washing step is readily determined by X-ray diffraction analysis of the washed product to determine that only the single pyrochlore phase is present.

The final step of the process of the invention is to remove residual acid from the acid-washed product and to dry the product. This can easily be done by filtering out the acidic wash solution and washing the filtered solids with water until the pH of the wash water is substantially constant.

The product may be separated and dried by various means, e.g., by filtration, centrifugation, vacuum drying, freeze drying and the like, as well as combinations of these. With any of the above methods, the product retains its very small particle size and does not require further size reduction for use in screen printable thick film compositions.

The acid solutions used to wash out the $Bi_2O_3$ and M oxides are a valuable source of $Bi(NO_3)_2$ or $BiCl_3$ and, thus, may be recycled after making suitable concentration adjustments. This will also help to lower product cost and reduce potential waste disposal problems.

Though in the above description and in the following examples, the process of the invention was described and conducted in a batch-wise manner, it will be recognized by those skilled in the art that the various steps or combination of the various steps might well be conducted in a continuous manner as well.

Test Procedures

Resistance Measurement and Calculations

The test substrates are mounted on terminal posts within a controlled temperature chamber and electrically connected to a digital ohm-meter. The temperature in the chamber is adjusted to 25° C. and allowed to equilibrate, after which the resistance of each substrate is measured and recorded.

The temperature of the chamber is then raised to 125° C. and allowed to equilibrate, after which the resistance of the substrate is again measured and recorded.

The hot temperature coefficient of resistance (TCR) is calculated as follows:

$$\text{Hot TCR} = \frac{R_{125^\circ C.} - R_{25^\circ C.}}{R_{25^\circ C.}} \times (10{,}000)\ \text{ppm/°C.}$$

The values of $R_{25^\circ C.}$ and Hot TCR are averaged and the $R_{25^\circ C.}$ values are normalized to 25 microns dry printed thickness, and resistivity is reported as ohms per square at 25 microns dry print thickness. Normalization of the multiple test values is calculated with the following relationship:

$$\text{Normalized Resistance} = \frac{\text{Avg. measured resistance} \times \text{Avg. dry print thickness, microns}}{25\ \text{microns}}$$

Laser Trim Stability

Laser trimming of thick film resistors is an important technique for the production of hybrid microelectronic circuits. [A discussion can be found in *Thick Film Hybrid Microcircuit Technology* by D. W. Hamer and J. V. Biggers (Wiley, 1972) p. 173ff.] Its use can be understood by considering that the resistances of a particular resistor printed with the same resistive ink on a group of substrates has a Gaussian-like distribution. To make all the resistors have the same design value for proper circuit performance, a laser is used to trim resistances up by removing (vaporizing) a small portion of the resistor material. The stability of the trimmed resistor is then a measure of the fractional change (drift) in resistance that occurs after laser trimming. Low resistance drift—high stability—is necessary so that the resistance remains close to its design value for proper circuit performance.

Experimental Procedure and Apparatus

A number of different experimental mixing configurations were found to provide rapid intimate mixing of the precipitating bismuth oxycarbonate with the fine particle $RuO_2$ powder. One configuration used for a large number of preparations is described below.

A 500 mL capacity glass separatory funnel was positioned above the glass mixing jar of a standard 1250 cc Hamilton Beech ® food blender. Attached to the outlet end of the separatory funnel was a 10 mm OD glass tube of sufficient length to extend down through the jar covered to within ½" (1.27 cm) of the blender blades.

The fine particle $RuO_2$ or $IrO_2$ powder can be introduced into the mixture by either slurry addition from the separatory funnel or by placement directly into the blender jar. If the $RuO_2$ or $IrO_2$ powder is placed in the separatory funnel along with the alkaline carbonate solution, then it is desirable to insert a glass tube into the separatory funnel so that gas bubbles can be used to stir the solution and thereby keep the $RuO_2$ or $IrO_2$ in suspension during the addition of this slurry to the liquid in the blender jar. Combining the $RuO_2$ or $IrO_2$ directly with the Bi salt solution in the blender jar gave equivalent results.

The contents of the separatory funnel were added slowly to the solution in the jar. The change in pH in the jar was followed by the use of a pH meter electrode mounted in the jar. By this means, it was possible to determine the degree of completion of the precipitation process during the high speed mixing.

The mixing procedures took place over a 15–30 minute period. After the completion of the addition, stirring was maintained another 15–30 minutes. The resulting precipitate was then separated by filtration from the liquid and washed with distilled water to remove the water-soluble by-products. The precipitate was dried in air, followed by firing in air at temperatures ranging from 400° to 650° C. for times ranging from 50 minutes to 16 hours.

The fired samples were then treated with aqueous acid solvent using either mechanical or ultrasonic stirring. The process time ranged from 30 to 120 minutes. Acid concentration ranged from concentrated (65% vol.) acid down to a dilution as low as 2% vol. acid. Acids used were nitric, hydrochloric and combinations of these.

It was found beneficial to use high surface $RuO_2$, as this facilitated the reaction with the oxides or oxide precursors.

The invention will be better understood by reference to the following examples in which all compositions are presented in parts by weight unless otherwise indicated. All surface areas reported in the following examples were determined by BET nitrogen absorption analysis.

EXAMPLE 1

Using the apparatus described above, a large sample of $Bi_2Ru_2O_7$ was prepared in the following manner.

48.0 g of $Bi_2O_3$ were dissolved in 100 mL of $HNO_3$ plus sufficient water to insure solution at room temperature and then diluted to 1500 mL with additional water. To accommodate the limited capacity of the blender, this $Bi(NO_3)_3$ solution was divided into five equal parts and each part processed in an identical manner.

300 mL of the $Bi(NO_3)_3$ solution were combined with 1.40 g of $RuO_2$ in the blender jar using the lowest blending speed. After 5 minutes of mixing, the speed was increased to the maximum obtainable, and 450 mL of saturated $Na_2CO_3$—$H_2O$ solution was slowly added continuously from the separatory funnel during a 15 minute period. At the conclusion of the carbonate addition, the pH of the slurries was between 9.0 and 9.6. Stirring was continued for another 10 minutes before transferring the slurry to a 600 mL capacity fritted glass funnel. All five slurries were transferred to the funnel and then washed with distilled water until the pH of the wash solution became constant.

The sample was dried overnight and then air fired at 520°–530° C. for one hour at maximum temperature. After cooling it was leached with 15 vol. % $HNO_3$–85 vol. % $H_2O$ for about one hour. This was followed by washing with pure water to remove all the nitrates. After drying, X-ray analysis of the product indicate single phase $Bi_2Ru_2O_7$ with an average particle size of 220 Å (22 nm). Surface area was found to be 35 $m^2/g$.

EXAMPLE 2

A sample of $Bi_2Ru_2O_7$ was prepared, starting with $Bi_2O_3$ and HCl—$H_2O$ as the solvent rather than $HNO_3$—$H_2O$.

This solution was placed in the blender jar used in Example 1 and combined with 1.40 g of $RuO_2$ at low speed. After 5 min of mixing, the speed was increased to maximum speed, and 450 mLs of saturated $Na_2CO_3$—$H_2O$ solution were added slowly and continuously during a 15 minute period. The stirring was continued for an additional 30 minutes.

The resultant slurry was then transferred to a fritted glass funnel and washed with distilled water to remove soluble chloride by-product. After drying, but before firing, the product was analyzed by X-ray and found to be essentially $Bi_2O_2CO_3$. $RuO_2$ did not appear on the pattern. The powder was fired at 530° C. in air for approximately 4 hrs., and it was leached with a solution containing 10 vol. % $HNO_3$, 30 vol. % HCl, and 60 vol. % $H_2O$. After washing with additional water, X-ray analysis indicate the product to be single phase $B_2Ru_2O_7$, having a surface area of 45 $m^2/g$.

EXAMPLES 3–8

The procedures used in following Examples 3–8 to make $Bi_2Ru_2O_7$ were carried out in a manner similar to that used for Examples 1 and 2 in that a dispersion of $RuO_2$ was formed in the blender jar using an aqueous solution of bismuth nitrate or bismuth chloride by using either $Bi(NO_3)_3.5H_2O$ in a nitric acid solution and $Bi_2O_3$ in an $HNO_3$ or HCl aqueous solution. The alkaline carbonate solution was added to the blender. All other steps were carried out in a manner similar to that used in Examples 1 and 2. The amount of $RuO_2$ used, the details of the bismuth nitrate in chloride solution, and the alkaline carbonate, firing conditions, leach compositions and indicated product particle size from X-ray diffraction analysis and surface areas are given in Table 1, which follows:

TABLE 1

Preparation of Bismuth-Ruthenium Pyrochlore

| Example No. | 3 | 4 | 5 | 6 | 7 | 8 |
|---|---|---|---|---|---|---|
| $RuO_2$, g | 2.8 | 1.4 | 1.4 | 2.8 | 3.0 | 1.4 |
| Bi Solution | | | | | | |
| $Bi(NO_3)_3.5\ H_2O$, g | — | — | 20.0 | 40.0 | 40.0 | 20.0 |

TABLE 1-continued

| Preparation of Bismuth-Ruthenium Pyrochlore | | | | | | |
|---|---|---|---|---|---|---|
| Example No. | 3 | 4 | 5 | 6 | 7 | 8 |
| $Bi_2O_3$, g | 19.2 | 9.6 | — | — | — | — |
| $H_2O$, mL | 530 | 380 | 390 | 280 | 250 | 290 |
| $HNO_3$, mL | — | 20 | 10 | 20 | 10 | 10 |
| HCl, mL | 70 | — | — | — | — | — |
| Alkaline Carbonates Soln. | | | | | | |
| $Na_2CO_3$, mL | 450 | 450 | — | 500 | 500 | 500 |
| $NaHCO_3$, mL | — | — | 500 | — | — | — |
| Firing Conditions | | | | | | |
| Temperature, °C. | 530 | 520 | 550 | 530 | 525 | 510 |
| Time, hrs. | 4 | 4 | 4 | * | 4 | 4 |
| Leach Composition | | | | | | |
| $HNO_3$, % vol. | 15 | 15 | 10 | 10 | 10 | 5 |
| HCl, % vol. | — | — | — | 30 | — | 15 |
| $H_2O$, % vol. | 85 | 85 | 90 | 60 | 90 | 80 |
| Particle size, Å | 210 | 220 | — | 210 | — | — |
| Surface Area, $m^2/g$ | 38 | 35 | 29 | 37 | 22.5 | 21 |

*Fired in a belt furnace having an effective heating length of 24 inches (61 cm) at a belt speed of 0.25 inches (0.64 cm) per minute.

All of the pyrochlores produced had surface areas well above 15 $m^2/g$.

EXAMPLE 9

A sample of $Bi_{1.9}Cu_{0.1}Ru_2O_7$ was prepared using $Na_2CO_3$ as the precipitating agent.

$Bi(NO_3)_3.5H_2O$, 5.20 g, and $Cu(No_3(2).3H_2O$ g were dissolved in 200 mL $H_2O$ containing sufficient $HNO_3$ to retain the $Bi(NO_3)_3$ in solution. This solution was placed in the blender jar and stirred at maximum speed. 500 mL of a saturated $Na_2CO_3$—$H_2O$ solution containing 0.34 g $RuO_2$, suspended by means of a stream, gas bubbles was slowly and continuously added in a 15 minute period to the bismuth-copper nitrate. The stirring was continued an additional 10 minutes after funnel addition was complete. The resulting precipitate was transferred to a filter funnel and washed to remove the nitrates. The mixture was dried, fired in air at 450° C. for 1 hour, after which the temperature was increased to 520° C., and firing continued for an additional hour.

This product was leached with 10 vol. % $HNO_3$, 90 vol. % $H_2O$ using an ultrasonic bath and followed by water washing.

X-ray analysis indicated the product to be a single phase $Bi_2Ru_2O_7$-type material. Within the experimental X-ray fluorescence analysis, the formula for this sample was determined to be $Bi_{1.90}Cu_{0.10}Ru_2O_7$. Surface area was found to be 36 $m^2/g$.

EXAMPLES 10–12

The procedures of Example 9 were used to prepare a series of three bismuth ruthenate pyrochlore compositions which contained no copper or other substitution in the bismuth lattice, i.e., in which x=0.

Details of the reagent solutions, process conditions and the particle size of the resultant bismuth ruthenate products are given in Table 2, which follows:

TABLE 2

| Preparation of Bismuth Ruthenium Pyrochlore | | | |
|---|---|---|---|
| Example No. | 10 | 11 | 12 |
| $RuO_2$, g | 0.774 | 1.10 | 1.54 |
| Bi Solution | | | |
| $Bi(NO_3)_3.5\ H_2O$, g | 14.1 | 20.0 | 28.2 |
| $H_2O$, mL | 200 | 250 | 2500 |
| $HNO_3$, mL | 10 | 10 | 20 |

TABLE 2-continued

| Preparation of Bismuth Ruthenium Pyrochlore | | | |
|---|---|---|---|
| Example No. | 10 | 11 | 12 |
| Alkaline Carbonates Soln. | | | |
| $(NH_4)_2CO_3$, mL | 400 | 400 | 1000 |
| Firing Conditions | | | |
| Temperature, °C. | 625 | 600/620 | 515 |
| Time, hrs. | 0.8 | 0.5/0.6 | 16 |
| Leach Composition | | | |
| $HNO_3$, % vol. | 65 | 65 | 10 |
| $H_2O$, % vol. | 35 | 35 | 90 |
| Particle size, Å | 210 | 278 | 297 |
| Surface Area, $m^2/g$ | 24 | 20 | 20 |

All of the products had a desirably high surface area of at least 20 $m^2/g$. It is noteworthy that the more extended firing times appeared not to have any significant effect on surface area. The materials which had been fired for quite long times (Example 12) exhibited substantially the same surface areas as those which had been fired for only about one hour (Examples 10 and 11).

EXAMPLES 13–15

In Examples 9–12, the $Bi_2O_2CO_3$ reaction mixture was prepared by addition of $RuO_2$ suspended in a solution of $Na_2CO_3$ to a solution of $Bi(NO_3)_2$. In Examples 13–15, however, the $Bi_2O_2CO_3$ reaction mixture was prepared by addition of aqueous $Bi(NO_3)_2$ solution to the suspension of $RuO_2$ in the saturated solution of $Na_2CO_3$. As can be seen from the data given in Table 3 below, this change in procedure had no substantial effect on the properties of the bismuth ruthenate pyrochlore compositions made therefrom.

TABLE 3

| Preparation of Bismuth Ruthenium Pyrochlore | | | |
|---|---|---|---|
| Example No. | 13 | 14 | 15 |
| $RuO_2$, g | 0.258 | 0.129 | 0.774 |
| Bi Solution | | | |
| $Bi(NO_3)_3.5\ H_2O$, g | 9.6 | 2.35 | 14.1 |
| $H_2O$, mL | 350 | 350 | 350 |
| $HNO_3$, mL | 10 | 10 | 10 |
| Alkaline Carbonates Soln. | | | |
| $(NH_4)_2CO_3$, mL | 200 | 200 | 400 |
| Firing Conditions | | | |
| Temperature, °C. | 625 | 640 | 625 |
| Time, hrs. | 2.0 | 0.8 | 0.8 |
| Leach Composition | | | |
| $HNO_3$, % vol. | 30 | 65 | 65 |
| $H_2O$, % vol. | 70 | 35 | 35 |
| Particle size, Å | 300 | 280 | 210 |
| Surface Area, $m^2/g$ | 19 | 24 | — |

EXAMPLE 16

Finely divided dry $Bi_2O_2CO_3$ powder was prepared in the following manner:

Bismuth nitrate (221.42 g, 0.456 mol) was dissolved in 80 mL nitric acid and 160 mL water. The resulting clear solution was transferred to a 2 L round bottom flask equipped with a mechanical stirrer, condenser and addition funnel. Saturated sodium carbonate (1.1 L) was added to the briskly stirred reaction mixture to yield a white precipitate. The reaction mixture was then filtered and washed with 2 L warm water. The yield after drying in air at 20° C. was quantitative. The product was characterized by X-ray and found to have a $Bi_2O_2CO_3$ pattern. The surface area was 21 $m^2/g$.

EXAMPLE 17

In Examples 1–15, the reaction mixture of $Bi_2O_2CO_3$ and $BO_2$ was prepared by precipitation of the bismuth in the presence of the $BO_2$ suspended in the form of an aqueous slurry. However, the reaction mixture can also be prepared by blending of the dry materials as is shown by the following examples.

A reaction mixture of dry finely divided $RuO_2$ (1.4 g 0.105 mol) and $Bi_2O_2CO_3$ (13.4 g, 0.026 mol) from Example 16 was prepared by placing these materials in a bottle which was agitated by hand for about 1 minute. The blend was then fired at 550° C. for 5 hours. The resulting product was slurried in 400 cc of 20% $HNO_3$ for 1 hour and then filtered. The pyrochlore product was then washed with 200 cc of water and dried at 120° C. for 1 hour. The yield was 3.81 g (99%). The product was characterized by X-ray diffraction and found to be pure $Bi_2Ru_2O_7$. Particle size as measured by X-ray line broadening was 244 Å. Surface area was 36 $m^2/g$. Scanning electron microscopic examination of the product showed the morphology to be identical to the product prepared by the slurry process described above.

The quite advantageous use of the pyrochlores of the invention in thick film resistors is illustrated by the following additional examples.

EXAMPLES 18–23

A series of screen printable compositions was formulated from the pyrochlore of Example 3 by dispersing a mixture of the pyrochlore and lead glass frit into an inert organic medium of the type normally used for thick film compositions. By varying the pyrochlore/glass weight ratio in each of the formulations, a series of resistors was prepared having a sheet resistance of from over 800,000 ohms per square down to as low as about 350 ohms per square.

The resistors were fabricated by silk screen printing the above-described dispersions through a 200 mesh screen onto a 96% $Al_2O_3$ substrate having identical prefired Pd/Ag terminations. The printed substrates were then fired in a belt furnace at a peak temperature of 850° C. for about 10 minutes with a total firing cycle time of about 1 hour. The final thickness of the resistor layers was about 25 μm.

The sheet resistance and HTCR of each of the resistors was then determined by the above-described procedures. All of the resistors exhibited quite acceptably small HTCR values. These data are given in Table 4 below.

TABLE 4

HTCR OF BISMUTH RUTHENIUM PYROCHLORE RESISTORS

| Ex. No. | Wt. Ratio Pyrochlore/Glass* | Sheet Resistance (Ω/□) | HTCR |
|---|---|---|---|
| 18 | 7/63 | 810,400 | +46 |
| 19 | 8/62 | 506,800 | +54 |
| 20 | 9/61 | 26,500 | +87 |
| 21 | 10/60 | 17,400 | +62 |
| 22 | 15/55 | 1,500 | +130 |
| 23 | 20/50 | 357 | +141 |

*Glass composition: 65.0% PbO, 34.0% $SiO_2$, 1.0% $Al_2O_3$

EXAMPLES 24–28

A further series of screen printable compositions was formulated from a pyrochlore of Example 3 in the same manner as Examples 18–23 and used to form resistors, which were then tested to determine their laser trim stability. The as fired resistance of the members of the series ranged from over 200,000 to as low as 300. All resistors were then laser trimmed to 1.5X their as fired resistance values. All of the resistors exhibited acceptably low changes in resistance after 1178 hours at 150° C. These data are given in Table 5 below.

TABLE 5

LASER TRIM STABILITY OF BISMUTH RUTHENIUM PYROCHLORE RESISTORS

| Ex. No. | Wt. Ratio Pyrochlore/Glass* | Sheet Resistance (Ω/□) | Change in Resistance (%) |
|---|---|---|---|
| 24 | 7/63 | 217,000 | 0.51 |
| 25 | 7.75/62.25 | 81,200 | 0.57 |
| 26 | 8.5/61.5 | 24,900 | 0.53 |
| 27 | 14.25/55.75 | 1,670 | 1.00 |
| 28 | 20/50 | 300 | 0.69 |

*Glass composition: 65.0% PbO, 34.0% $SiO_2$, 1.0% $Al_2O_3$

I claim:

1. A process for making a pyrochlore corresponding to the formula $Bi_{2-x}M_xB_2O_{7-z}$, wherein M is selected from the group consisting of cadmium, copper, lead, indium, gadolinium, silver and mixtures thereof, B is selected from the group consisting of ruthenium, iridium and mixtures thereof, x is from 0 to 0.5, and z is from 0 to 1, comprising the sequential steps of:

(a) firing an intimate admixture of finely divided particles of $BO_2$, $Bi_2O_2CO_3$ and carbonate(s) of M when x is greater than zero at a temperature between the thermal decomposition temperature of $Bi_2O_2CO_3$ and 650° C. in an oxidizing atmosphere to form a reaction product comprising $Bi_2O_3$, $Bi_{2-x}M_xB_2O_{7-z}$ and oxide(s) of M, the mole ratio of Bi to B being at least 1.4 to 1;

(b) forming a dispersion of the fired reaction product of step (a) in dilute aqueous mineral acid in an amount and for a time sufficient to dissolve substantially all the $Bi_2O_3$ and, if present, oxides of M in the reaction product; and (c) separating the acid-treated reaction product of step (b) from the dispersion medium.

2. The process of claim 1 in which the mole ratio of Bi to B is at least 4 to 1.

3. The process of claim 1 in which the intimate admixture of finely divided particles of $BO_2$, $Bi_2O_2CO_3$ and carbonate(s) of M is derived by (a) forming a dispersion of finely divided particles of $BO_2$ in an aqueous acidic solution of $BiX_3$, and, when x is greater than zero, $MX_m$, wherein X is selected from the group consisting of nitrate, chloride and mixtures thereof and m is the valence of M;

(b) adding to the dispersion of step (a) with agitation to effect rapid dispersion therein an aqueous solution of an alkaline carbonate selected from the group consisting of sodium carbonate, potassium carbonate and, except when M is copper, ammonium carbonate and mixtures thereof to effect precipitation of finely divided particles of $Bi_2O_2CO_3$ and carbonate(s) of M throughout the dispersion, the amount of alkaline carbonate being sufficient to precipitate substantially all of the Bi and M from solution; and (c) drying the dispersion of step (b).

4. The process of claim 1 in which B is ruthenium.

5. The process of claim 3 in which the alkaline carbonate is sodium carbonate.

6. The process of claim 4 in which x and z are zero.

* * * * *